US009821280B2

(12) United States Patent
Cooke

(10) Patent No.: US 9,821,280 B2
(45) Date of Patent: Nov. 21, 2017

(54) INLINE INFUSION DEVICE AND METHOD FOR INTRODUCTION OF A GAS INTO A CONTAINED MEDIA

(71) Applicant: Robert C. Cooke, Wendell, NC (US)

(72) Inventor: Robert C. Cooke, Wendell, NC (US)

( * ) Notice: Subject to any disclaimer, the term of this patent is extended or adjusted under 35 U.S.C. 154(b) by 110 days.

(21) Appl. No.: 15/005,147

(22) Filed: Jan. 25, 2016

(65) Prior Publication Data

US 2016/0136592 A1 May 19, 2016

Related U.S. Application Data

(63) Continuation-in-part of application No. 13/837,101, filed on Mar. 15, 2013, now abandoned, which is a continuation-in-part of application No. 13/370,358, filed on Feb. 10, 2012, now Pat. No. 8,608,138.

(51) Int. Cl.

| | |
|---|---|
| ***B01F 3/04*** | (2006.01) |
| ***B01F 5/04*** | (2006.01) |
| ***B01F 5/10*** | (2006.01) |
| ***B01F 15/00*** | (2006.01) |

(52) U.S. Cl.

CPC ..... *B01F 3/04262* (2013.01); *B01F 3/04099* (2013.01); *B01F 5/0471* (2013.01); *B01F 5/0496* (2013.01); *B01F 5/106* (2013.01); *B01F 15/0022* (2013.01); *B01F 15/00344* (2013.01); *B01F 2003/04276* (2013.01); *B01F 2003/04879* (2013.01); *B01F 2003/04893* (2013.01); *B01F 2215/0431* (2013.01); *B01F 2215/0468* (2013.01)

(58) Field of Classification Search

CPC ..... C02F 3/22; C02F 3/26; B01F 3/04; B01F 3/04099

USPC ..... 261/76, 77; 96/243; 366/101

See application file for complete search history.

(56) References Cited

U.S. PATENT DOCUMENTS

| | | | |
|---|---|---|---|
| 3,165,562 | A | 1/1965 | Young et al. |
| 4,259,360 | A | 3/1981 | Venetucci et al. |
| 5,261,452 | A | 11/1993 | McAndrew et al. |
| 5,376,311 | A | 12/1994 | DeGuzman |
| 6,103,128 | A | 8/2000 | Koso et al. |
| 6,767,008 | B2 | 7/2004 | Shane |

FOREIGN PATENT DOCUMENTS

| | | | |
|---|---|---|---|
| EP | 1151786 | A1 | 11/2001 |
| JP | 2003311268 | A * | 11/2003 |

OTHER PUBLICATIONS

Porous Ceramic Filters, Refraction Technologies, http://www.refraction.com/filtration.asp, Jul. 7, 2011.

* cited by examiner

*Primary Examiner* — Robert A Hopkins

(74) *Attorney, Agent, or Firm* — James G. Passé; Passé Intellectual Property, LLC

(57) ABSTRACT

The present invention discloses a system for introducing a gas into a contained media such as a pond or lake. Water is removed from the media, gas introduced, and then the water removed to the contained media.

15 Claims, 3 Drawing Sheets

INLINE INFUSION DEVICE AND METHOD FOR INTRODUCTION OF A GAS INTO A CONTAINED MEDIA

This application is a continuation-in-part of U.S. non-provisional application Ser. No. 13/837,101 filed on Mar. 15, 2013, which is a continuation-in-part of U.S. non-provisional application Ser. No. 13/370,358 filed on Feb. 10, 2012, now issued U.S. Pat. No. 8,608,138, issued on Dec. 17, 2013, and are incorporated herein in their entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a method and system for the infusion of a media into contained water or other liquid media. In particular, the present invention relates to a diffusion mixing device for the introduction of a media, such as a gas, into a contained water media that is at atmospheric pressure or into a pressurized pipeline of flowing media.

Description of Related Art

The introduction of a gas into a liquid, especially while the liquid is contained, such as in a basin, pool, tank or the like, has been the object of many methods and apparatuses. The purpose is normally to dissolve one or more gases in a liquid media, such as water or other liquid, or in some cases another gas, at a given point. The utility of such processes is widespread, including lowering the pH of the contained media, increasing levels of beneficial gases in the media, treating media containing pollutants, adding nitrogen, carbon dioxide or oxygen to water, gasoline, and the like treatment of the media. Carbon dioxide, carbonic acid, oxygen, and nitrogen gas are frequently added to water or other liquids for their beneficial uses. Ozone is utilized as a sterilizing agent for contained waste water, swimming pools, and other areas where traditionally chlorine is used.

A number of different arrangements have been used and are still being used to introduce gas into a contained liquid media. Addition of pressure, increasing flow turbulence, changes of temperature, and the like are all utilized in the introduction process. In some methods, gas is bubbled into the media or mechanical aeration devices are utilized. Other methods include placing sparger stones, diffusers and mixers in the media.

The main issues with the current technology are that there is a huge problem with the fouling of the internal parts of the introduction or mixing devices and frequently there are difficulties depending on the depth of the media. Further, there is still much inefficiency in the process and frequently the introduction is incomplete. Even further, where there is a multiplicity of gases to be introduced, the problems tend to be compounded and the system is even less efficient.

BRIEF SUMMARY OF THE INVENTION

The present invention relates to the discovery that if gases are passed into a pressurized chamber before entering into the contained media, then the above problems with gas introduction into a contained media are largely avoided.

Accordingly, one embodiment of the present invention is a system for the introduction of one or more gases into a contained liquid media comprising:

a) a contained liquid media;

b) a circulation pump and pipe positioned to create flowing liquid media in the pipe pumped from the contained media and returning it to the contained media;

c) one or more gas infusion devices, each device comprising a containment enclosure pressurized to at least 5 psi; an inlet for introducing the one or more gases into the enclosure; an outlet in the gas infusion device in communication with the flowing liquid media in the pipe; and d) a gas source for introducing the one or more gases into the inlet.

In yet another embodiment of the invention, there is a method for the introduction of one or more gases into a contained media comprising:

a) selecting one or more gas infusion devices, each device comprising a containment enclosure pressurized to at least 5 psi; an inlet for introducing the one or more gases into the enclosure; an outlet for attaching the infusion device into flowing media in a pipe;

b) creating flowing media in the pipe by placing a first end of the pipe in the contained media and pumping it back to a second end, which delivers the media back to the contained media and past the gas infusion device;

c) positioning the outlet in fluid communication with the flowable media in the pipe;

d) attaching a gas source to the inlet of the infusion device; and e) passing the gas from the gas source, through the infusion device and into the flowable media while media is flowing from and to the contained media.

DETAILED DESCRIPTION OF THE INVENTION

Figure 1:
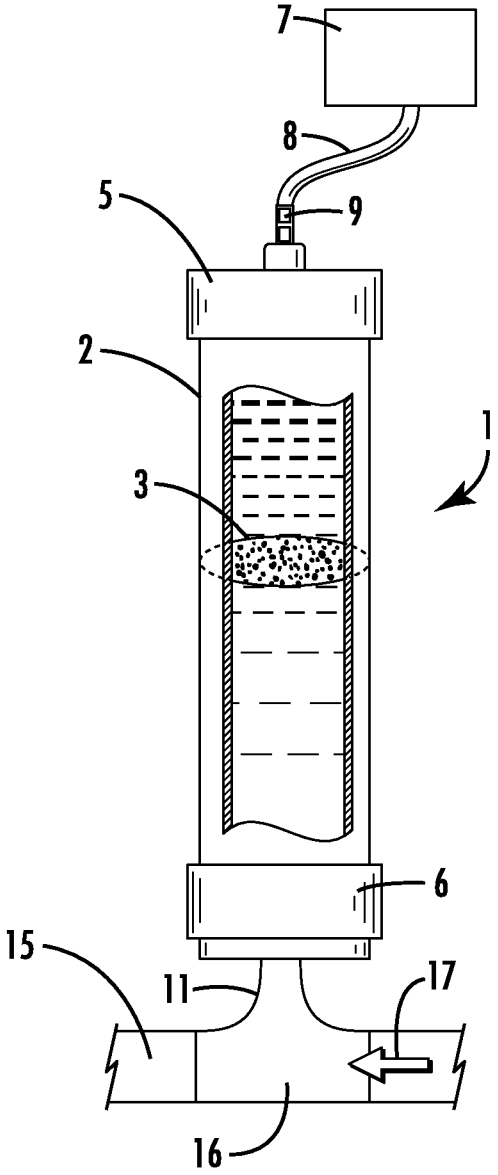
FIG. 1 is a cutaway side view of the infusion device of the present invention.

While this invention is susceptible to embodiment in many different forms, there is shown in the drawings, and will herein be described in detail, specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The terms "about" and "essentially" mean±10%.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

References throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitations thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "contained liquid media" refers to one or more of water or other liquid media sitting in any kind of container such as a basin, tank, lagoon, pond, pool, or the like. Liquids, such as water, gasoline, diesel fuel, natural gas, or any other liquid or gas chemicals are included in the term "contained media". The term includes where the contained media is static, i.e. no current, or non-static, i.e. flowing in some manner, in the container, or in/out of the container. The term assumes that the temperature and pressure conditions of the media are such that the gas or gases are readily absorbed or mixed into the media to maintain target levels of pH, oxygen, nitrogen, ozone, or other beneficial gas for the process. "Flowing media" refers to a liquid or the like flowing through a transport pipe or other place.

As used herein, the term "gas infusion device" refers to a device that is capable of introducing one or more gases into a flowing media optionally passed through a diffusing material and then introducing the infused media into the contained media. The one or more gases can remove or combine with selected components contained in the flowing media and serve to purify or isolate undesirable components in the flowable media. In the present invention, it comprises a novel set of components. The gas infusion device of the present invention comprises a "containment enclosure" such as a cylinder which can contain or pass through the gas being infused into the flowing media under pressure. In one embodiment, a cylinder enclosure with a cap that is sealed from the atmosphere other than the gas inlet and outlet of the device is contemplated. One could, for example, take an open cylinder or pipe and cap both ends or weld them shut as desired. The containment enclosure can be materials such as a metal (like stainless steel), plastic, glass, or the like, compatible with the gas, pressure, and conditions of the process and one skilled in the art can select such materials in view of the disclosure herein and the selected one or more gases. The enclosure is pressurized to at least 5 psi, and, in one embodiment, between about 15 and 40 psi. In another embodiment the device is pressurized to over 40 psi. The gas infusion device (or plurality thereof), in one embodiment, is mounted next to the contained media, e.g. on a concrete pad adjacent to the contained media.

The present invention containment enclosure has an inlet and optional outlet for introduction of the gas and optional removal of the gas for an introduction into the flowing media and then introduction of media into the contained media. For example, any convenient method could be utilized. Standard gas connectors could be used for attaching gas hoses and the like to the containment cylinder. Once again, a hose type connection can be used for connecting the pipe, or as shown in the drawing, an inline outlet is utilized. In one embodiment, it contains a porous ceramic cylinder.

The gas source utilized in the present invention is from any normal source. In some embodiments it is carbon dioxide, oxygen, or the like. A gas tank, a gas generating mechanism, or the like, is anticipated. In one embodiment, a plurality of gases is added, either through separate gas inlets or through a mixing device prior to the infusion device. In one embodiment, a novel mixing device includes a T-shaped mixing chamber wherein each gas is introduced from a side of the T-shape for mixing in the chamber. Mixing is accomplished by the intermixing flow of the gases as they move into and then out of the mixing chamber. The mixing chamber has an outlet which delivers the mixed gas to the infusion device. Note, in one embodiment of the present invention there can be a plurality of infusion devices for infusing the same or multiple gases.

The method of the present invention comprises attaching the gas infusion device outlet to a pipe with flowing media and then the flowing media passing into the contained media where it circulates. A source of one or more gases is attached to the infusion device inlet(s). Once the media is flowing in the pipe, it is withdrawn from the contained media by a pump, the gas is introduced into the infusion device. From there it flows out the gas infusion device into the pipe mixing with the flowing media. The flowing media then flows into the contained media, introducing the gas into the contained media. In one embodiment, the flowing media is the same as the contained one but it could be different, and in one embodiment, is selected from the list of contained media. In one embodiment, the contained media is pumped to the device of the invention from the contained media and then returned to the contained media after treatment.

Now referring to the drawings, FIG. 1 is a side view of a gas infusion device of the present invention. Gas infusion device 1, consists of containment enclosure cylinder 2. The containment cylinder 2 is an enclosed structure by means of top cap 5 and bottom cap 6. Gas is provided to the device via gas containers 7 and gas tube 8. The containment cylinder 2 has inlets 9 such as a gas tube connection as shown, but any inlet means is contemplated. Finally, gas exits the device 1 via outlet 11 which is attached to the bottom cap 6 in this embodiment and is attached to tube 15 via tube connector 16 feeding the gas into media flow 17. One skilled in the art can substitute designs other than this particular embodiment in view of the disclosure and use herein. In one embodiment, the entire system is computer controlled, e.g. to control pH.

Figure 2:
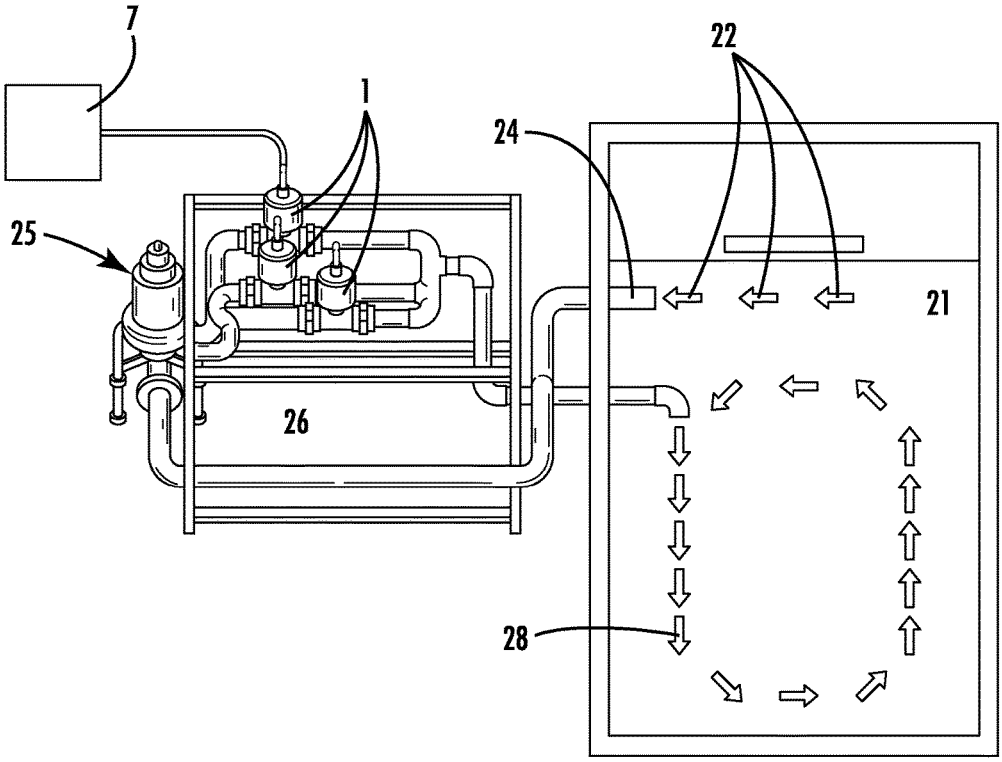
FIG. 2 is a side view of an embodiment of the present invention showing the system in a contained basin.

FIG. 2 is an embodiment of a system for use in a contained water aeration basin. In this system, contained media aeration basin 21 has waste water 22 sucked into pipe 24 by the action of circulation (optionally submersible) pump 25 next to basin 21 in a closed loop piping system. The flowing water 22 is pumped, flowing past a series of three gas infusion devices 1 (which are sitting on a concrete slab 26)—these devices inject oxygen into the flowing media, after which the water flows back into basin 21 delivering the oxygenated water into basin 21. Delivering this water into the basin 21 causes circulation of the oxygenated water (arrow 28) and continued oxygenation of water in the basin 21.

Figure 3:
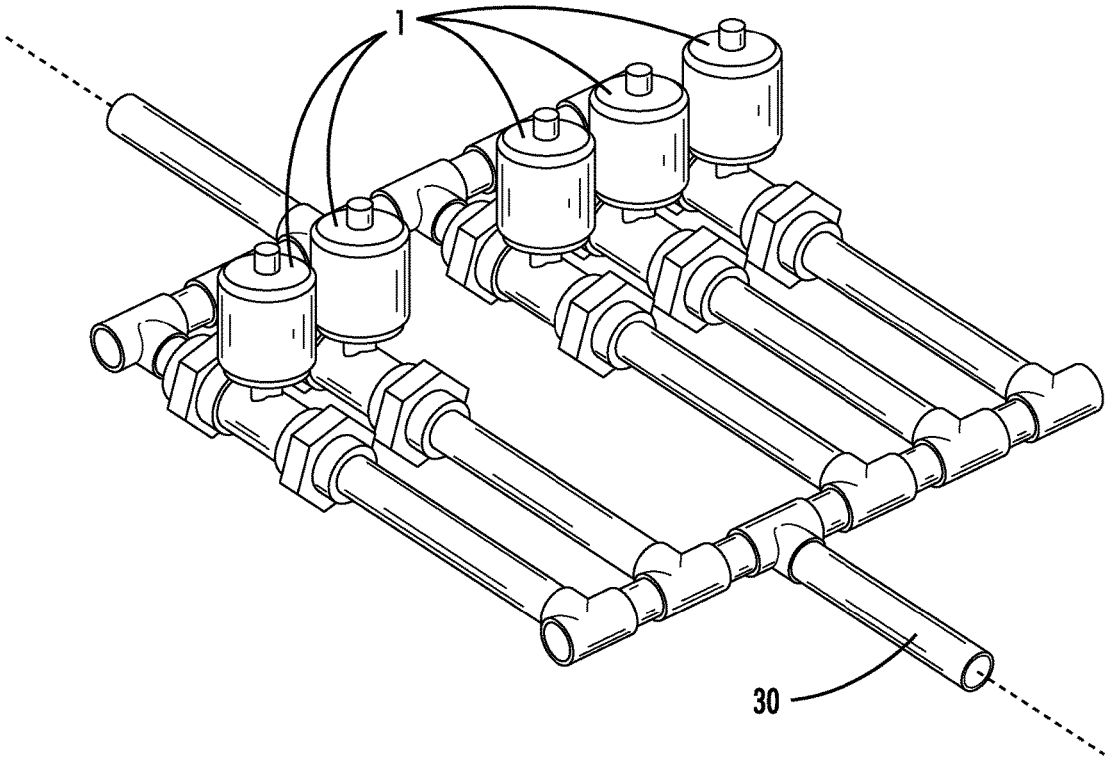
FIG. 3 is a view of the system with five infusion devices for one system.

FIG. 3 is a view of a system with five gas infusion devices 1. In this view, the waste water from a pump is delivered flowing past each of the gas diffusing devices 1 to be oxygenated before returning the water to the basin via pipe 30.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A system for the introduction of one or more gases into a contained liquid media comprising:

a) a contained liquid media;

b) a circulation pump and pipe positioned to create flowing liquid media in the pipe pumped from the contained media and returning it to the contained media;

c) one or more gas infusion devices, each device comprising a containment enclosure pressurized to at least 5 psi; an inlet for introducing the one or more gases into the enclosure; an outlet in the gas infusion device in communication with the flowing liquid media in the pipe; and d) a gas source for introducing the one or more gases into the inlet.

2. The system according to claim 1 wherein the flowing media is water.

3. The system according to claim 1 wherein there are a plurality of gasses introduced into the infusion device.

4. The system according to claim 1 wherein at least one of carbon dioxide or oxygen is introduced into the mixing chamber.

5. The system according to claim 4 wherein enclosed in the containment enclosure is a porous diffusion material having a pore size of from about 5 microns to about 90 microns wherein the diffusion material is positioned such that the gas passes through the diffusion material and into the flowing media.

6. The system according to claim 4 wherein the pore size is from about 10 microns to about 50 microns.

7. The system according to claim 1 wherein a rate the gas is introduced into the media is computer controlled.

8. The system according to claim 5 wherein the diffusion material is porous ceramic material.

9. A method for the introduction of one or more gases into a contained media comprising:

a) selecting one or more gas infusion devices, each device comprising a containment enclosure pressurized to at least 5 psi; an inlet for introducing the one or more gases into the enclosure; an outlet for attaching the infusion device into flowing media in a pipe;

b) creating flowing media in the pipe by placing a first end of the pipe in the contained media and pumping it back to a second end, which delivers the media back to the contained media and past the gas infusion device;

c) positioning the outlet in fluid communication with the flowable media in the pipe;

d) attaching a gas source to the inlet of the infusion device; and e) passing the gas from the gas source, through the infusion device and into the flowable media while media is flowing from and to the contained media.

10. The method according to claim 9 wherein there are a plurality of infusion devices infusing a gas into the flowable media.

11. The method according to claim 9 wherein the flowable media is water, gasoline, diesel fuel, or natural gas.

12. The method according to claim 9 wherein at least one of carbon dioxide or oxygen is introduced into the mixing chamber.

13. The method according to claim 9 wherein the containment enclosure is enclosing a porous diffusion material having a pore size of from about 5 microns to about 90 microns wherein the diffusion media is positioned such that the gas passes through the diffusion material.

14. The method according to claim 9 wherein the diffusion material is a ceramic material.

15. The method according to claim 9 wherein the method is computer controlled.

* * * * *